US005527221A

United States Patent [19]

Brown et al.

[11] Patent Number: 5,527,221

[45] Date of Patent: Jun. 18, 1996

[54] AMUSEMENT RIDE CAR SYSTEM WITH MULTIPLE AXIS ROTATION

[75] Inventors: Ronald L. Brown, Phelan; Eduard Feuer, Glendale, both of Calif.

[73] Assignee: Ride & Show Engineering, Inc., San Dimas, Calif.

[21] Appl. No.: 892,445

[22] Filed: Jun. 2, 1992

[51] Int. Cl.[6] ..... A63G 1/34

[52] U.S. Cl. ..... 472/31; 472/36; 472/43; 104/78

[58] Field of Search ..... 472/37, 31, 36, 472/43; 104/25; 402/27

[56] References Cited

U.S. PATENT DOCUMENTS

| | | | |
|---|---|---|---|
| 892,070 | 6/1898 | Murphy . | |
| 913,956 | 3/1909 | Harllee . | |
| 924,458 | 6/1909 | Henry . | |
| 973,105 | 10/1910 | Chamberlain, Jr. | 472/37 X |
| 1,844,852 | 2/1932 | Harvey . | |
| 2,964,094 | 12/1960 | Gariepy . | |
| 3,196,557 | 7/1965 | Davidsen et al. | 472/31 X |
| 3,408,068 | 10/1968 | Winton | 472/37 |
| 3,554,130 | 1/1971 | Broggie | 104/75 |
| 3,677,188 | 7/1972 | Bordes . | |
| 4,008,500 | 2/1977 | Hall, Jr. . | |
| 4,170,943 | 10/1979 | Achrekar | 104/75 X |
| 4,600,239 | 7/1986 | Gerstein et al. . | |
| 4,844,543 | 7/1989 | Ochiai . | |
| 4,879,849 | 11/1989 | Hollingsworth, III et al. . | |
| 5,022,708 | 6/1991 | Nordella et al. . | |

FOREIGN PATENT DOCUMENTS

| | | | |
|---|---|---|---|
| 19708 | of 1893 | United Kingdom | 472/27 |

*Primary Examiner*—Carl D. Friedman
*Attorney, Agent, or Firm*—Christie, Parker & Hale

[57] ABSTRACT

An amusement car ride system having multiple axis rotation of the car with decentralized control processing and centralized system monitoring allows significant improvement in ride control and flexibility. The seat portion 28 of the car is attached to a dolly 14 through an articulating structure providing rotation about a vertical axis and a horizontal axis. Drive motors 56, 60 connected to the articulating structure provide rotation about the axes and a programmable controller 64 connected to the drive motors provides power and position information. Sensors connected to the controller sense actual position of the drive motor, position of the car relative to the track at desired locations, and general elements of car status. A communication system integral with the controller communicates to a master controller in one or more cars for overall control of the system.

15 Claims, 11 Drawing Sheets

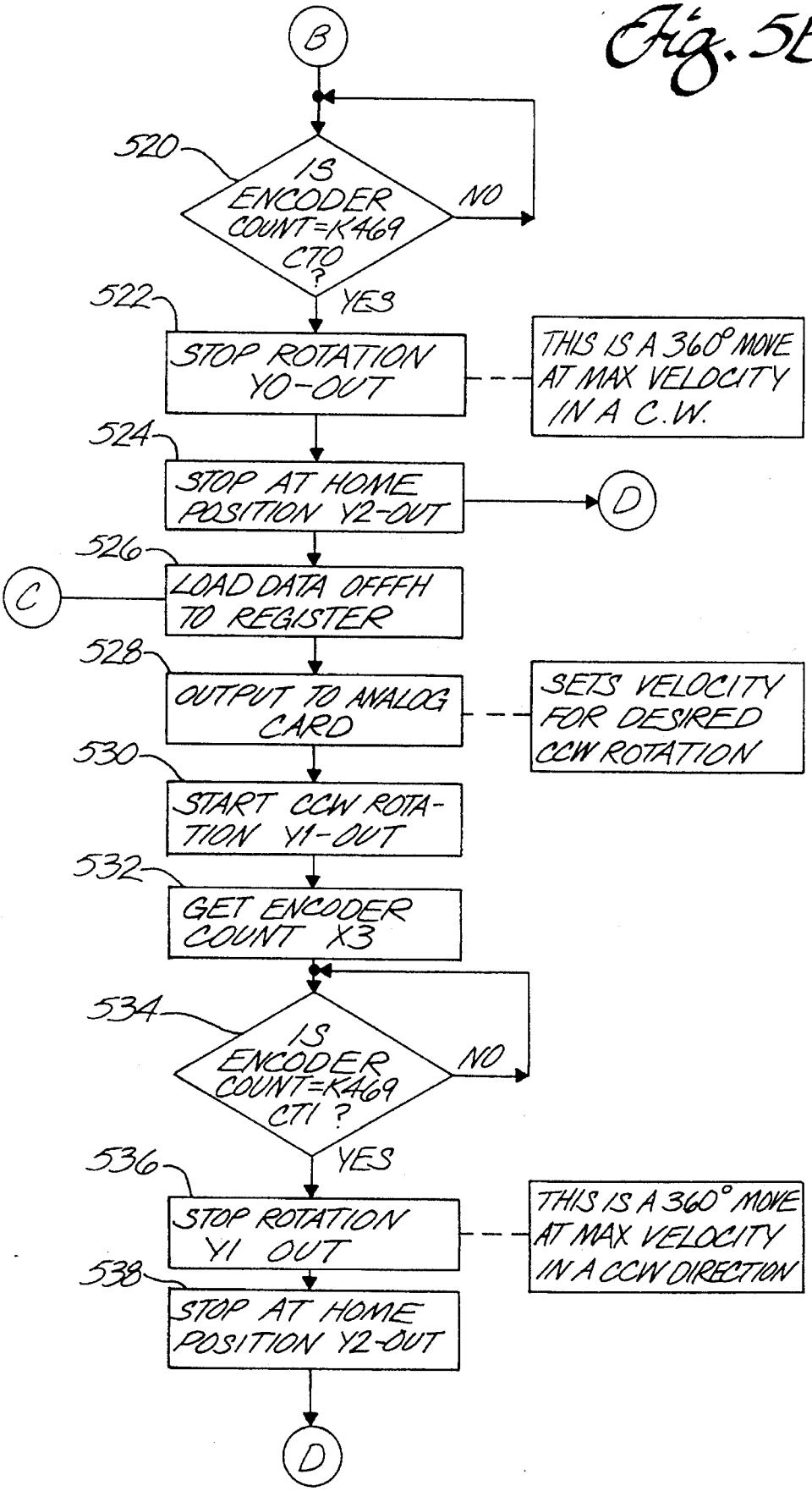
Fig. 5B
B
520
IS ENCODER COUNT=K469 CT0 ?
NO
YES
522
STOP ROTATION Y0-OUT
THIS IS A 360° MOVE AT MAX VELOCITY IN A C.W.
524
STOP AT HOME POSITION Y2-OUT
D
526
C
LOAD DATA 0FFFH TO REGISTER
528
OUTPUT TO ANALOG CARD
SETS VELOCITY FOR DESIRED CCW ROTATION
530
START CCW ROTATION Y1-OUT
532
GET ENCODER COUNT X3
534
IS ENCODER COUNT=K469 CT1 ?
NO
YES
536
STOP ROTATION Y1 OUT
THIS IS A 360° MOVE AT MAX VELOCITY IN A CCW DIRECTION
538
STOP AT HOME POSITION Y2-OUT
D

AMUSEMENT RIDE CAR SYSTEM WITH MULTIPLE AXIS ROTATION

BACKGROUND OF THE INVENTION

1. Field of the Invention

The present invention relates generally to the field of amusement rides wherein patrons seated in cars are moved along a track and the car is pointed in various directions to view specific portions of the attraction. The present invention more particularly provides for independant control of multiple axes of rotation for an amusement ride car with decentralized control processing and centralized system monitoring.

2. Prior Art

Amusement park rides and exhibit presentation systems employing cars, trams, or other means for moving patrons through the ride or exhibit vary significantly in size and complexity. Typically, cars seating two to four individuals are drawn about a track having various contours in both lateral and elevation planes. As the car traverses the track, various portions or segments of the amusement ride, including scenes intended to amuse or frighten the patrons are presented for viewing. To add flexibility in the presentation of the ride by the designer, the cars typically employ means to rotate the car about an axis on the dolly or platform following the track. This allows one scene to remain in view of the patrons seated in the car as the car passes the scene. Alternatively, rotating the car rapidly from one scene to another which was previously behind the patrons or out of view allows added shock value.

Similarly, for other forms of displays, such as museums, nature displays, and so on, which benefit from continuous motion of the patrons through the display, rotation of the viewing platform or seat occupied by the patrons to draw attention to specific portions of the exhibit or allow portions of the exhibit to remain in view for a longer period while continuing motion of the car is desired. For both display and amusement systems, the length of the track traversed by the cars may be significant and numerous changes in the relative. rotation of the viewing portion of the car may be necessary. In addition, numerous separate cars may be present on the track, each requiring motion control.

Prior art systems employ mechanical cam rails embedded within or adjacent the track to activate cam followers on the car to rotate the viewing portion or seat at appropriate locations. These systems are extremely reliable, however, the cost and complexity of such mechanical cam systems is high. In addition, once implemented, alteration of such mechanical systems. requires extensive replacement or refurbishment of mechanical parts. Consequently, the flexibility desired in design of various scenes and sequences in the amusement park ride or positioning of displays in an exhibit is severely limited. Particularly, in the exhibit domain, where changes may be made on a regular basis substituting art works or other displays, the rigid positioning of a mechanical cam system is entirely unsatisfactory.

In many cases, minor changes by the ride designer to achieve specific effects with various scenes or to accommodate other design requirements necessitated removal and replacement of large sections of the mechanical cam portions on the ride track. Particularly in systems having numerous lateral and elevation changes requiring exacting three dimensional design, such alterations are extremely expensive and time consuming. In addition, implementation of such changes without impacting the smooth transition of various rotations in the ride or creating noticeable jolts or oscillations irritating to the patrons is costly and technically challenging.

Rotation of the seat or viewing portion of the car about a second axis is often required to change the cant angle of the seat for better viewing or to maintain the seat in a horizontal position during elevation changes by the car on the track. In present systems, operation of a second cam in the vertical plane is required to achieve such rotations. The complexities and difficulties described with the vertical rotation of the seat are also present in this requirement for rotation about a horizontal axis.

The mechanical cam systems described for the prior art further suffer from the inability to rotate through a full 360° or more, which may be advantageous for certain rides or presentations. Due to the limitations of the prior art systems, it is desirable obtain rotation control for patron cars, which is essentially unlimited in rotation and to provide flexibility for initial position definition and alteration of position definition for ride rotation.

The present invention provides the capability for unlimited rotation control for the patron viewing seats and further allows great flexibility in original design and modification of the rotation profiles.

SUMMARY OF THE INVENTION

The present invention comprises a plurality of cars carried on a continuous track system. The cars are propelled along the track by conventional means, singly or in interconnected configuration. Each car comprises a dolly engaging the track and a seating system carried by the dolly. The seating system is connected to the dolly through an articulating structure providing rotation of the seat portion about a vertical axis extending through the seat perpendicular to the plane of the track and a horizontal axis through the seat parallel to the plane of the track.

A first drive motor is connected to the articulating member for rotation of the seat portion about the vertical axis. A second drive motor connected to the articulating member for rotation of the seat about the horizontal axis. A programmable controller is connected to the first and second drive motors and provides power and position information to the drive motors. A plurality of sensors connected to the controller sense actual position of the drive motor, position of the car relative to the track at desired locations, and general elements of car status for use by the controller in controlling the drive motors.

A communications system integral with the controller in each car communicates to a master controller in one or more cars to provide individual car status to the master controller. The master controller incorporates a remote communications device for transmission of collected status information to a remote controller for monitoring by operators of the ride. Operating instructions are provided from the remote controller through the remote communications system to the master controller by the operator for distribution to the individual car controllers.

A power transmission system provides power to the individual cars.

DESCRIPTION OF THE DRAWINGS

Details of the present invention will be more clearly understood with reference to the following drawings:

FIG. 5*a–d* is a flow chart for control software defining operation of a car controller in a desired positioning sequence.

DETAILED DESCRIPTION OF THE INVENTION

Figure 1:
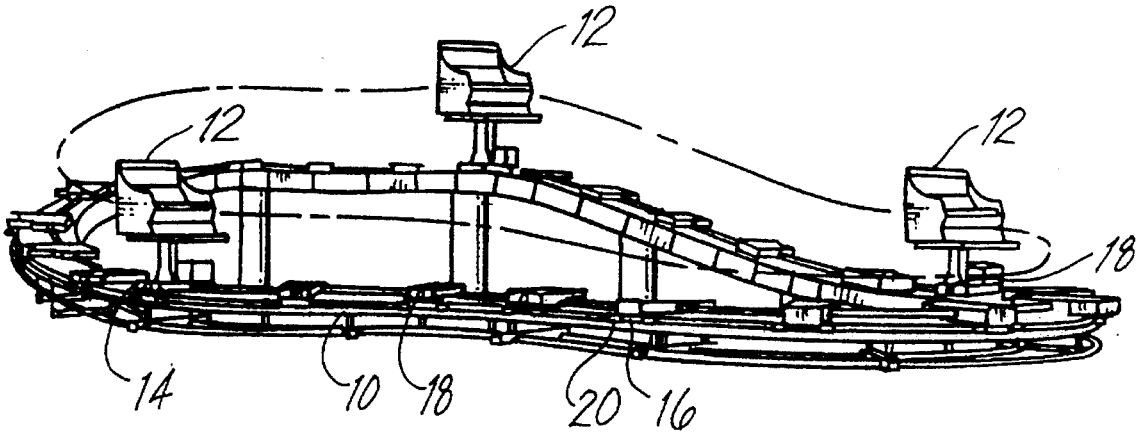
FIG. 1 is a pictoral presentation of a track system incorporating a plurality of cars containing the present invention.

Referring to the drawings, FIG. 1 discloses a small scale example of an embodiment of the present invention. A track 10 follows a multiply curved contour, including changes in elevation. A plurality of individual cars 12 are carried by the track. Each car incorporates a dolly 14 with a bogey 16 engaging the track. The bogey incorporates a plurality of vertical wheels 18 carrying the dolly on the track and horizontal wheels 20 which maintain alignment with the track. Those skilled in the art will recognize alternative capture methods for the bogey and track. Each car includes a self-contained control system and drive motors to be described in detail subsequently for position control of the seating portion of the car relative to the dolly.

Figure 2:
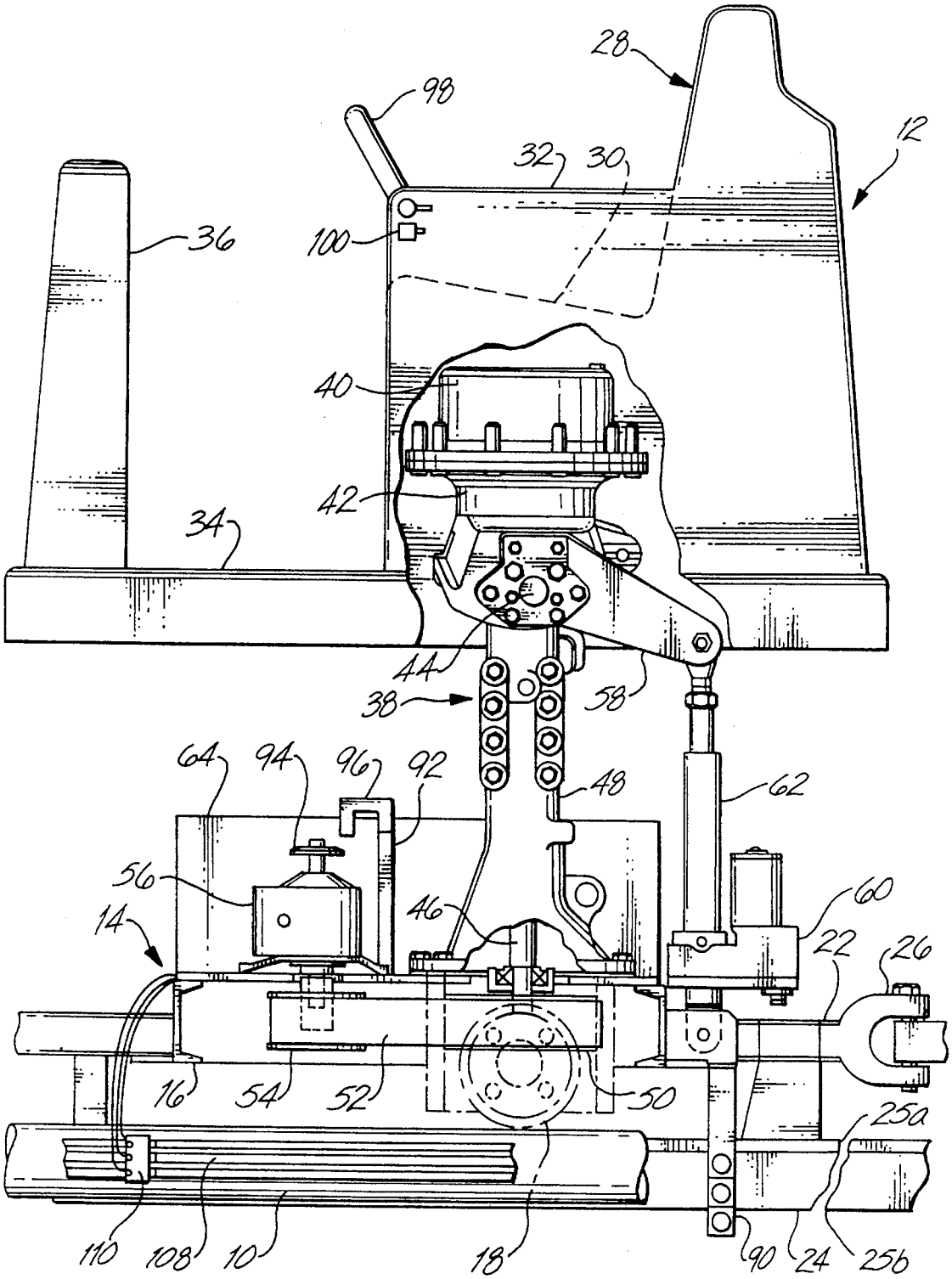
FIG. 2 is a pictoral view of one car demonstrating the articulation and drive system for rotation of the seating portion of the car and positioning of the controller, sensors, and power transmission system.

In the embodiment shown in the drawings, the cars are interconnected by trailing bars 22, blades 24 best seen in FIG. 2, are attached under the trailing bars substantially coplaner with the track rails. Propulsion for the embodiment shown in the drawings comprises a pair of pinch rollers beneath the track, driven by appropriate motors (not shown) which frictionally engage the blades to move the interconnected cars. The controllers and associated drive motors are placed in a straight section of the track wherein the cars are in alignment. As best seen in FIG. 2, the forward termination of each blade comprises a curved scarf shaped for clearance with a mating curved scarf at the trailing end of the blade attached to the prior car. This curved scarf arrangement allows for horizontal and vertical articulation of the trailing bars through joint 26 to accommodate lateral and elevation changes in direction of the track.

Detail of the individual cars is best seen in FIG. 2. Each car incorporates a seat portion 28, which is occupied by patrons participating in the amusement ride. The seat portion may take on various shapes depending on the theme of the ride and may incorporate seating for two, four, or more persons, as desired by the designer. Typical amusement park rides might incorporate animal shapes such as swans or elephants to carry the patrons, or boats, ships, chariots, space capsules, or other shapes corresponding to the theme of the ride envisioned by the designer. The embodiment shown in the drawings incorporates a simple seating portion including a bench seat 30 with arm rests 32, a foot rest 34 and knee protectors 36.

The seat portion is supported by an articulating member generally designated 38 which is fixed to the dolly. The seating portion is attached to a rotating head 40 which provides for rotation of the seating portion about a vertical axis 42, oriented perpendicular to the plane of the track. The rotating head is pivotally mounted in the articulating member for rotation about a horizontal axis 44 perpendicular to the plane of FIG. 2, as shown and parallel to the plane of the track. Rotation of the head member is accomplished through a drive axle 46, which extends through the case 48 of the articulating member. The axle terminates in a spline, not shown, on which a pulley 50 is mounted. Rotation of the pulley is accomplished by a drive belt 52 driven by a drive pulley 54 on a first drive motor 56. The axle 46 incorporates a universal joint (not shown) to allow the head member to pivot about the horizontal axis. A lever arm 58 connected to the head member provides mechanical leverage for rotation about the horizontal axis. In the embodiment shown in FIG. 2, a second drive motor 60 rotates a jack screw assembly 62 or other appropriate linear actuator, which is attached to a pivot point on the lever arm.

Actuation of the first drive motor in a clockwise or counter-clockwise direction provides corresponding rotation of the seat portion about the vertical axis. Similarly, rotation of the second drive motor results in rotation of the seat portion about the horizontal axis to cant the seat upward or downward to change the viewing angle of the patrons seated in the car, or to maintain the car in a level position during elevation changes in the track wherein the dolly is not in a horizontal position. Operation of the first drive motor is unconstrained allowing unlimited rotation of the seat portion in either a clockwise or counter-clockwise direction.

In the embodiment shown in the drawings, standard NEMA B electric motors are employed for the first and second drive motors. A 1.5 HP Reliance model number P14G9244 has been found satisfactory for initial implementations.

In the embodiment shown in the drawings, the articulating member comprises a heavy duty truck transaxle manufactured by Deere & Company, Moline, Ill., identified as the 1100 series. This transaxle provides the rotating components necessary for the articulating member with the necessary universal joint on the drive axle and appropriate casting attachments. The lever arm 58 employs the existing steering link bar attachment for the transaxle.

Figure 3:
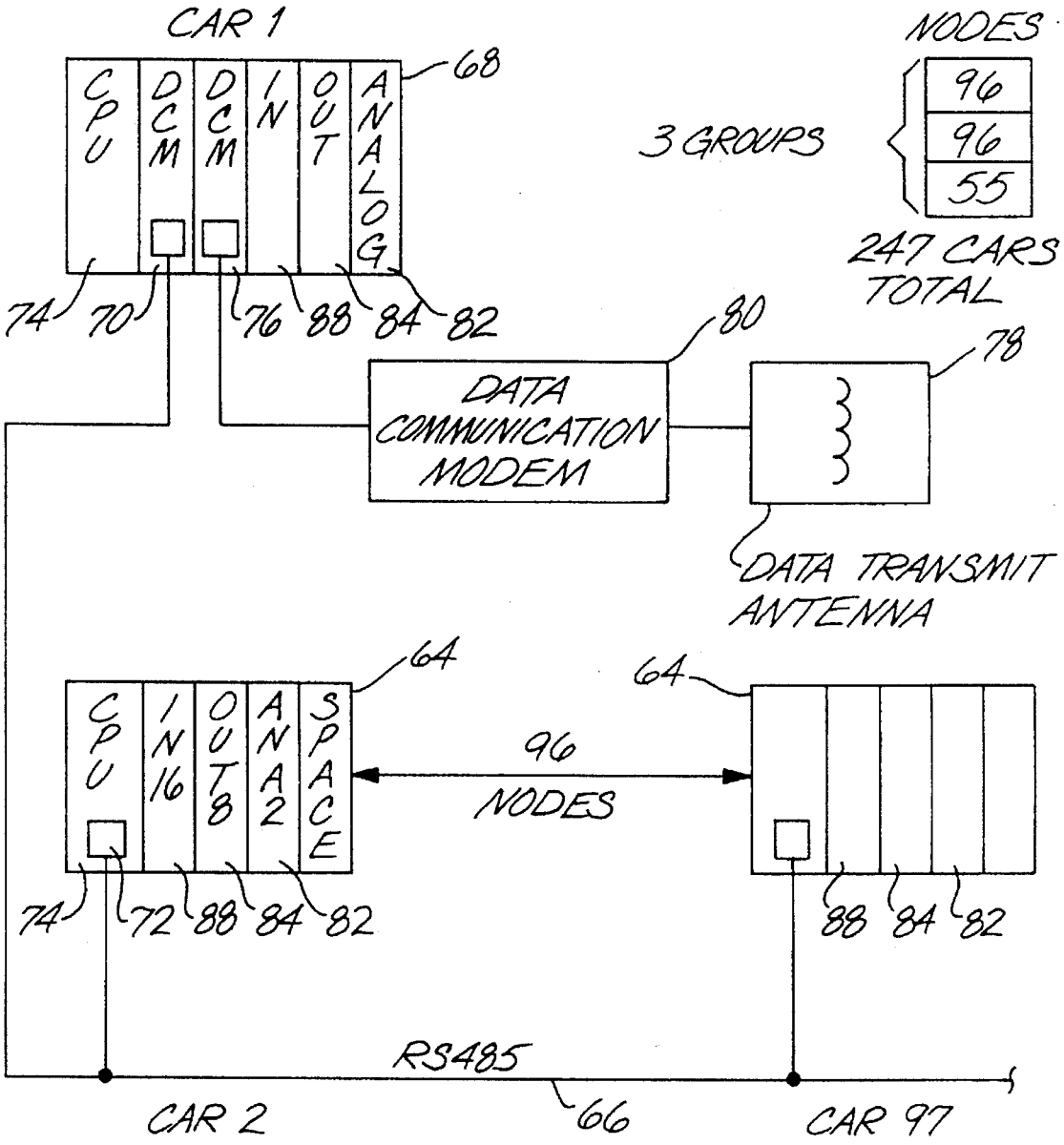
FIG. 3 is a block diagram of the integrated controller system.

Activation and control of the first and second drive motors is accomplished in the present invention by a controller 64 mounted to the dolly. In the invention as shown in the embodiment of the drawings, each car has a self-contained controller. As best seen in FIG. 3, the plurality of cars, each including a controller, are viewed as nodes in a network comprising the entire plurality of cars. Communication between the nodes is accomplished on a RS 485 or similar communications path 66. In the embodiment shown in the drawing, cabling for the RS 485 system is incorporated within the trailing bars interconnecting the cars. In one or more designated cars, a master controller 68 incorporates all of the functions for an individual controller, plus communications interfaces for receiving data from the other nodes on the network. A data communications modem 70 incorporated within the master controller provides the communications interface.

In the embodiment shown in the drawing, direct communication ports 72 are present in the central processing units 74 of the controller. For alternative applications requiring additional communications capability, a separate data communications modem is incorporated in each controller. A second data communications modem 76 is present in the master controller for communication with a remote controller (not shown). In the embodiment shown in the drawings, a data transmit antenna 78 is incorporated on the car carrying the master controller for transmission of data to a fixed antenna buried in the track system. For the embodiment presently implemented a Cyplex model Y5S18 data communications modem 80 in combination with a Cyplex model number 2100509-002 antenna 78 is employed for the remote communications system. Function of the remote communications system will be described in greater detail subsequently.

The controller in each car, of the embodiment shown in the drawings, incorporates digital and analog output capability. An analog output card 82 provides two voltage outputs for control of the drive motors drive power. A digital output card 84 allows designation of clockwise or counter-clockwise rotation of the seat portion through forward or reverse drive of the motor. Variable voltage produced by the analog card is employed for acceleration and/or velocity control of the rotation through a standard motor controller.

Figure 4:
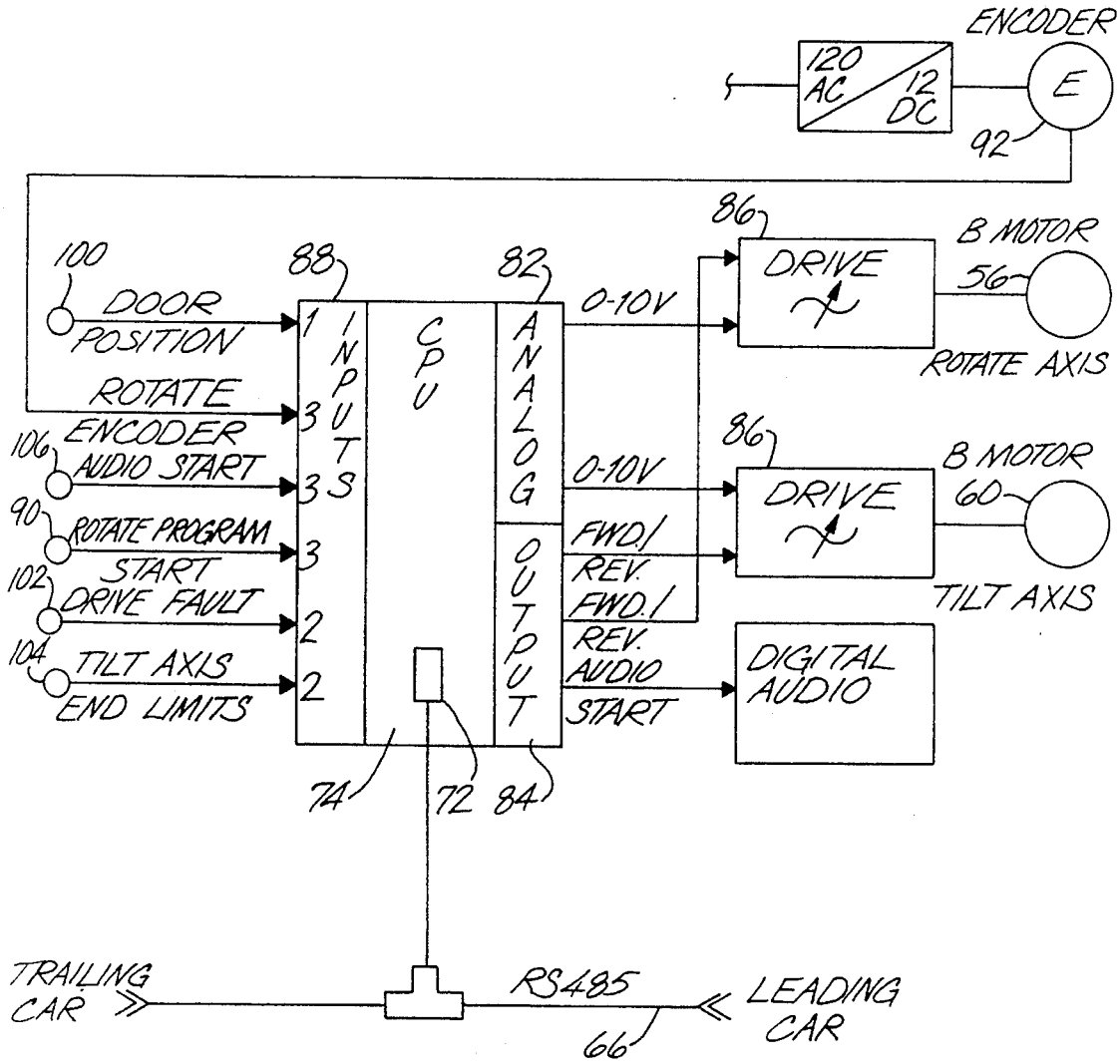
FIG. 4 is a block diagram for the individual car controller system.

As best seen in FIG. 4, for each controller, 0–10 volt analog output is provided to each motor drive 86 and a 2 bit digital signal for forward and reverse control of the motor is provided from the digital output to each motor drive. In the embodiment shown in the drawings, an adjustable frequency drive marketed under part number ATV151 series by Telemechanique is employed for the motor drive. Rotation about the vertical axis by the seat portion is accomplished by the first drive motor, while rotation about the horizontal, or tilt axis is accomplished by the second drive motor.

The controller also incorporates a digital input card 88 to receive external control inputs. Sensors incorporated on the car provide position information on the track for processing by the CPU to obtain appropriate controller response. Programming of the controller for various outputs based on input from the sensors or time intervals calculated by the CPU, establishes coordination of the rotation and tilt of the seat portion of the car. In the embodiment shown in the drawings, proximity sensors 90 attached to the dolly are activated by metal targets embedded in the track at desired locations. In the embodiment shown, 3 sensors are employed to provide 3 bits of digital information. The 3 sensors are connected to the digital input card providing information for the rotate program start input. In the embodiment shown employing 3 bits, 7 positions or operational sequences can be identified by the embedded activators in the track or 4 positions using 2 bits and a strobe. These distinct position inputs may employed to identify home position requirements for high accuracy positioning of the seat portion of the car to eliminate hysteresis or other inaccuracy created in the car position due to the inherent accuracy of the drive motor control system.

A position encoder 92 is employed to sense the position of the seat portion of the car in the rotate axis. In the present embodiment, a simple encoder is created by mounting a wheel 94 (as best seen in FIG. 2) to the axle of the drive motor, which incorporates magnetized portions or segments. A magnetic sensor head 96 creates pulses as the magnetic portion of the wheel rotates underneath the sensor. Counting of the pulses in an up/down counter defines the rotational position. As shown in FIG. 4, the output of the rotation encoder is provided to the controller at the input card. Additional track mounted and car mounted sensors provide information to the controller for car status and feature operation.

Safety considerations for patrons in amusement rides are paramount. As shown in FIG. 2, a safety bar 98, shown in the open position, is employed to restrain patrons in the seat. A sensor 100 detects the closed position of the safety bar. The position sensor input is provided to the controller as shown in FIG. 4 as a status bit. The status bit is analyzed by the CPU in the controller and if the safety bar is not closed, communication by the controller on the individual car to the master controller and subsequently to the remote controller, is employed to preclude ride start, or as a minimum, identify a fault to the operator of the system for manual response. Similarly, sensors 102 for independent sensing of motor operation are provided for status to the controller of any drive fault precluding normal operability of the car. Separate control of individual cars allows single cars to be removed from service for drive faults without impacting other cars in the system operators may simply preclude loading of the car containing the fault while continuing normal operation of all other cars on the ride. Drive fault communication by the individual controllers is communicated to the master controller and remote controller as previously described for the safety bar sensor indication.

In the embodiment shown in the drawing, a position sensor 104 for rotation about the horizontal or tilt axis is also provided as an input to the controller. Simple limit switches are employed to identify downward tilt, upward tilt, and centered position of the seat. A full range position encoder is substituted for systems wherein multiple tilt angle are desired.

As exemplary of alternate features provided by the controller, track mounted sensors 106 provide position indication for start of audio programming incorporated within each car. The controller through programming of the CPU responds to the audio start input by providing a digital output command for audio start to a digital audio system mounted within the car. In the embodiment shown in the drawings, a Guilderfluke model AB50 system is employed. The 3 bit input from the sensor allows placement of sensors for differing audio programs at different locations on the track. Program selection by the CPU based on the digitally encoded information from the audio start sensor allows appropriate digital output. for the audio system to select the desired program.

Programming of the CPU in the controller, for the cars, provides for control of the motion of the seat portion based on time sequence or external sensor inputs as previously described. FIGS. *5a–d* provide a flow chart of programming for the embodiment of the invention shown in the drawings to accomplish both sensor activated and timed position changes of the seat portion of the car. Upon power up of the controller, program start is accomplished and a routine for initializing the analog output card providing power to the motor drive controllers is implemented. The initialized command is identified in block 500, which results in loading of data 0000 hex to the output register, as identified in block 502, which is serially output to the analog card, as identified in block 504. Upon completion of the initialization, identified by decision block 506, the program transitions into active operation.

The CPU in the controller monitors the input card for rotate program start bits from the track mounted sensors as identified in decision blocks 508 for a clockwise rotation request and 510 for a counter-clockwise rotation request. Receipt of a 360° clockwise rotation request from the sensors results in loading of data 0FFF hex to the output register, as identified in block 512, for output to the analog card, as identified in block 514. As previously described, the output to the motor drive controller comprises digital data identifying forward and reverse drive of the motor, and velocity or acceleration data. Output commanded by the CPU through the analog card for application of power to the motor drive controller, initiates the rotation as identified in block 516. The CPU then monitors the input card for the encoder count, as identified in block 518. The program transitions to the B input shown in FIG. 5*b*, wherein the CPU compares the encoder count to the desired end value for a 360° clockwise rotation, as. identified in decision block 520. When the encoder reaches the value indicating a 360° rotation, the CPU commands motor stop by removing power to the motor drive controller through the analog output as identified in block 522. In the embodiment shown in the drawings, a secondary sensor for identifying a "home" position of the seat portion of car is employed to correct for hysteresis or other accuracy limitations of the encoder and drive motors for positioning of the seat portion of the car. A positive position sensor, such as an optical. sensor receiving a light beam through a perforation in the magnetic sensor wheel of the encoder or magnetic proximity switch mounted physically to the seat portion of the car specifically identifies the home position for stopping rotation of the seat portion, as identified in block 524.

Figure 5A:
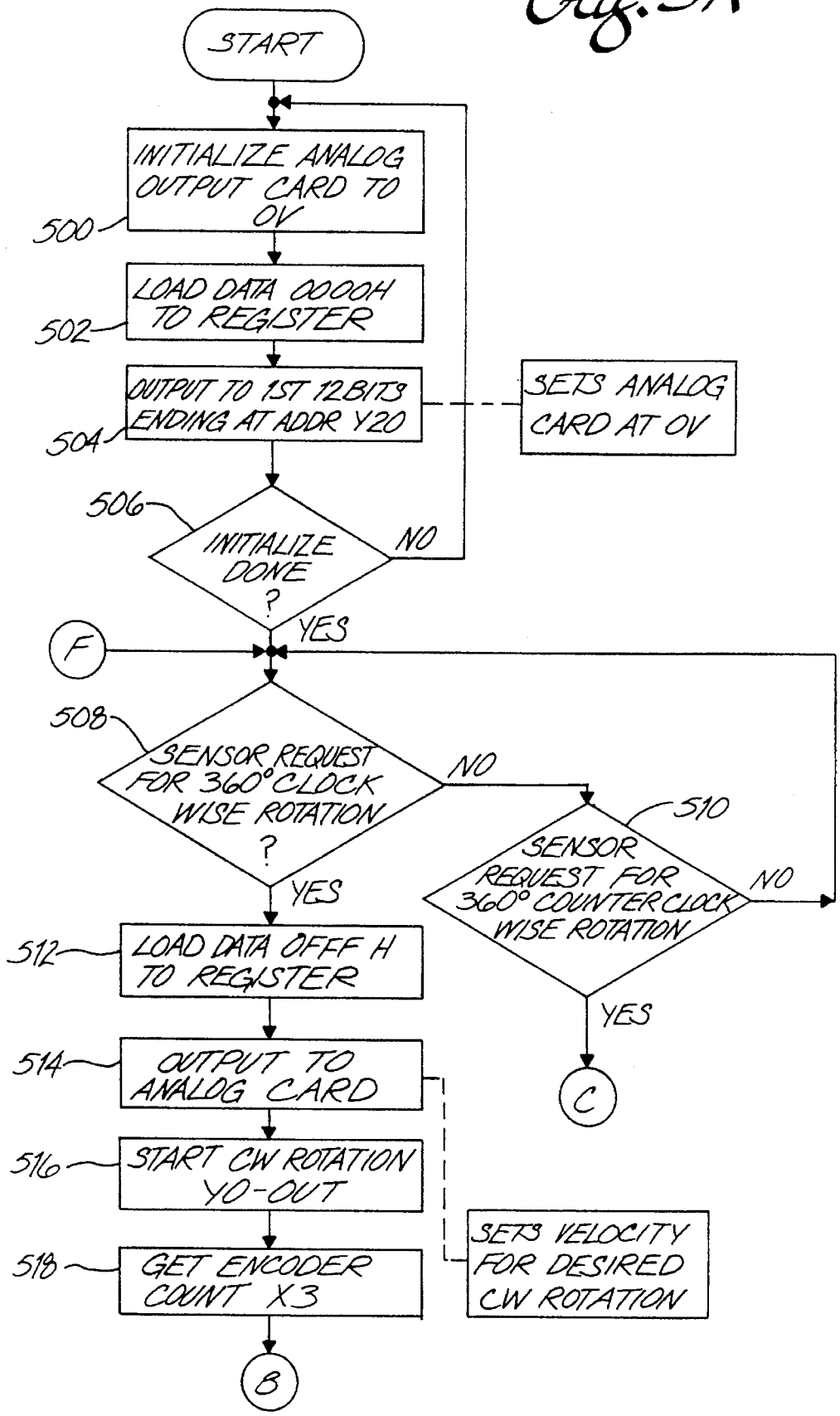

Returning to FIG. 5*a*, if the sensor command provides for a 360° counter-clockwise rotation of the seat portion of the car resulting in an affirmative response at decision block 510, the program transitions to entry point C, as shown in FIG. 5*b*. As previously described with respect to a clockwise rotation, data for 0FFF hex is loaded to the register, as identified in block 526 and the CPU provides and output to the analog card, as shown in block 528, setting the 0 to 10 volt output from the card, to the drive controller defining the velocity of the rotation. Rotation is initiated as shown in block 530 by output from the digital card identifying the reverse drive direction for the motor, as shown in block 530. The CPU monitors the encoder count, as identified in block 532, for comparison to the desired constant value identifying a 360° counter-clockwise rotation upon reaching the appropriate encoder count. The CPU stops rotation as identified in block 536, and again, based on a return to home position, the secondary sensor is employed for positioning the car at the home position, as identified in block 538.

Figure 5C:
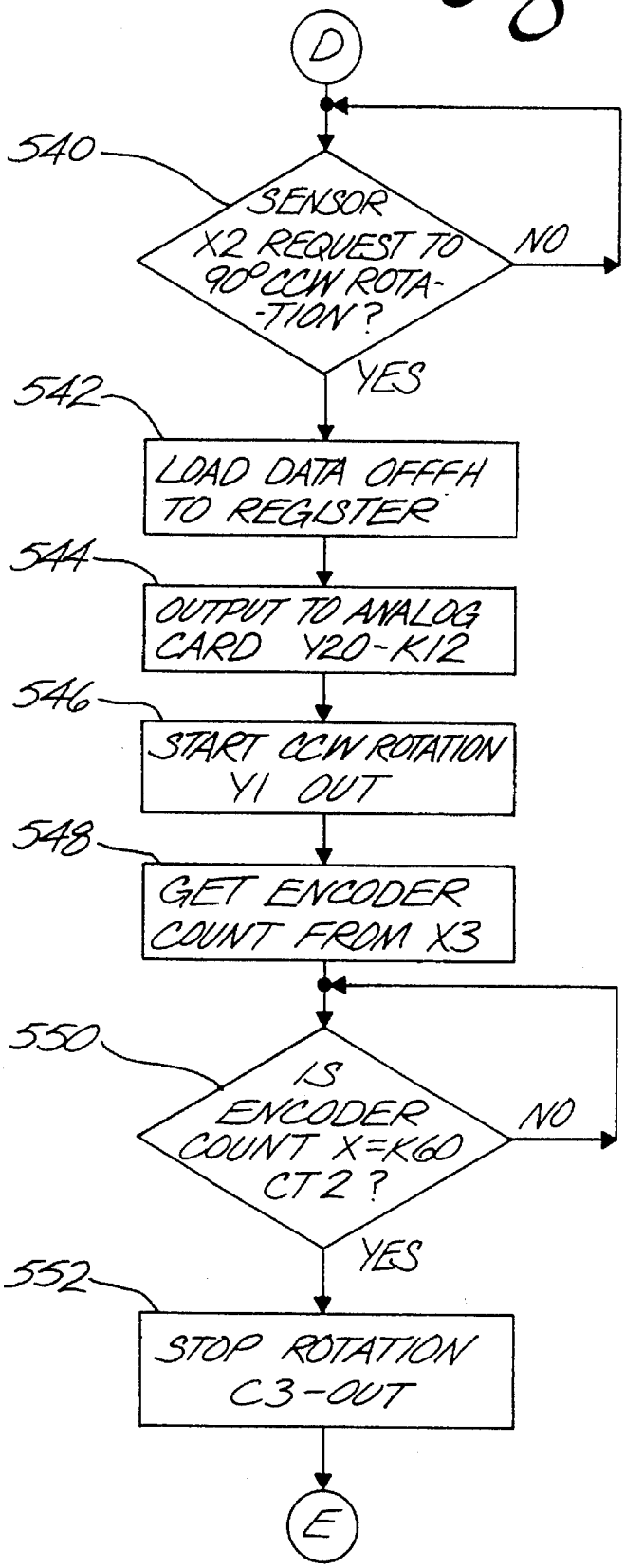

Upon completion of either the 360° clockwise rotation, or 360° counter-clockwise rotation, the program in the CPU transitions to entry point D, as shown on FIG. 5*c*. The rotate program start sensors are again monitored through the input card by the CPU for an input for a 90° counter-clockwise rotation, as identified in block 540. As previously described, the 3 bit input provided in the embodiment shown in the drawings for the rotate programs start allows for selection multiple rotation values or program sequences, which may be initiated by the CPU upon appropriate input from the rotate program sensors. Those skilled in the art will recognize that programming for a general sensor input of 3 bits subsequently evaluated by programming in the CPU for a programmed sequence match or rotation angle and direction, may be substituted for blocks 508, 510, and 540. Upon receiving the sensor input for a 90° counter-clockwise rotation, the CPU loads data 0FFF hex into the output register as identified in block 542. This data signifying a maximum velocity turn is output to the analog card for transmission to the motor drive controller, as identified in block 544. Start of the counter-clockwise rotation is initiated by output from the CPU through the digital output card for reverse direction of the motor to the drive controller, as identified block 546. The CPU, again, monitors the encoder, as identified in block 548 for an encoder count identifying a 90° counter-clockwise rotation. Upon reaching the appropriate count, as identified in decision block 550, the CPU stops rotation, as identified in block 552. Since the rotation is not to the home position, operation of the home sensor and appropriate positioning of the seat portion of the car is not employed.

Figure 5D:
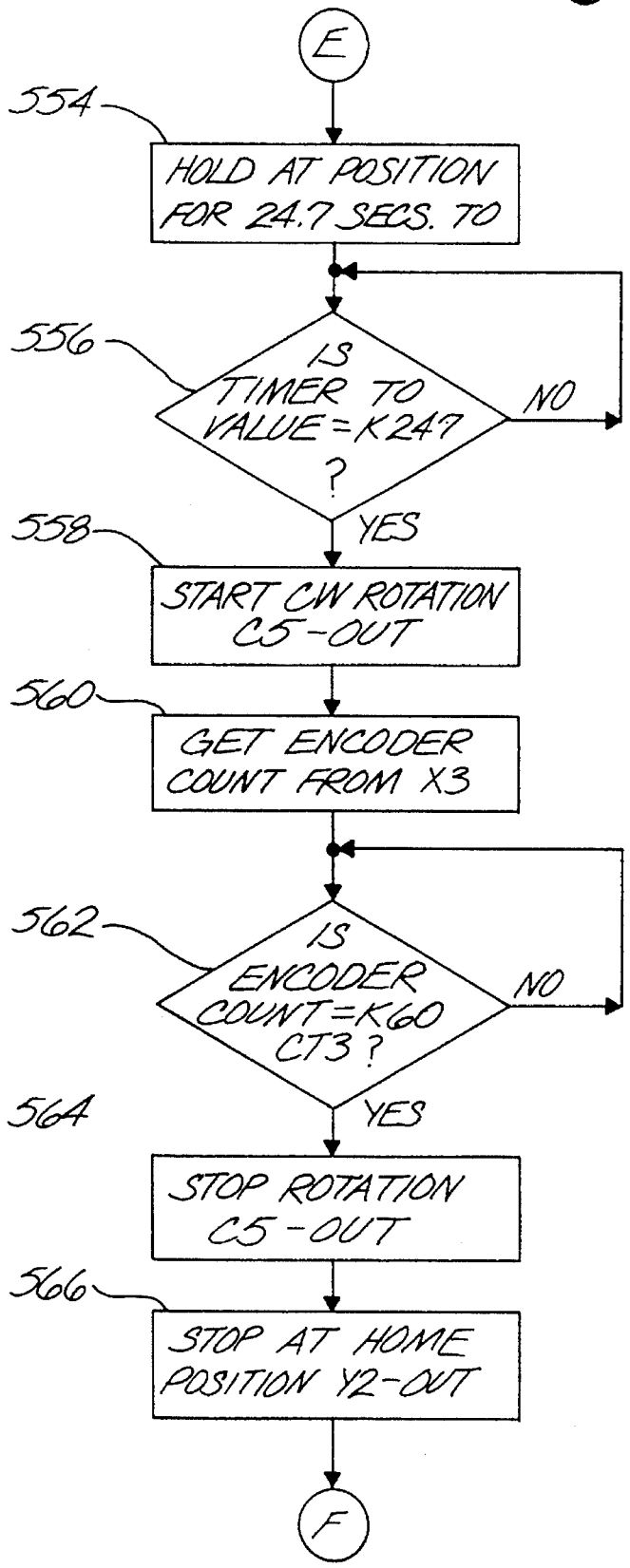

Upon completion of the 90° counter-clockwise rotation, the CPU program transitions to entry point E, as shown in FIG. 5*d*. Completion of the 90° counter-clockwise rotation results in initiation of a timed rotation by the CPU. A timer is initialized for a 24.7 second interval, as identified in block 554, and monitored the CPU for completion of the timed interval, as identified in decision block 556. Upon timeout, a clockwise rotation is initiated as identified in block 558. Block 558 incorporates the previously separated steps of output register loading, analog card output, and rotation output. The CPU monitors the encoder count, as identified in block 560.

The rotation encoder count is obtained as shown in block 560 and compared to the desired rotation in decision block 562. When the desired rotation is reached, rotation is stopped, as shown in block 564.

To complete operation of the sequence, the seat portion of the car is returned to the home position, as shown in block 566. The program then cycles to entry point F on FIG. 5*a* for continuous operation of the ride.

The program demonstrated in FIGS. 5*a–d* incorporates only rotation, both upon input from track mounted sensors and by timed program control. More sophisticated embodiments of the program provide for tilt axis rotation based on track mounted sensor inputs or timed control in a manner similar to that described.

The invention as embodied in the drawings employing 1.5 HP NEMA B motors operating at 240 volts 3-phase 5.5 amps. with 1800 RPM capability through standard gear drives under control of the Telemechanique ATV 151 motor drive controllers provides capability for acceleration/deceleration in the rotation axis of 16°/sec$^2$ and in the tilt axis of 15°/sec$^2$ with constant velocity in the rotate axis of 16° per second and in the tilt axis of 15° per second. Accuracy of the system employing the encoders described, is ±2°. The present invention avoids the requirement for complex and costly servomotor control systems through computer control of the standard motor drive controllers.

Figure 6A:
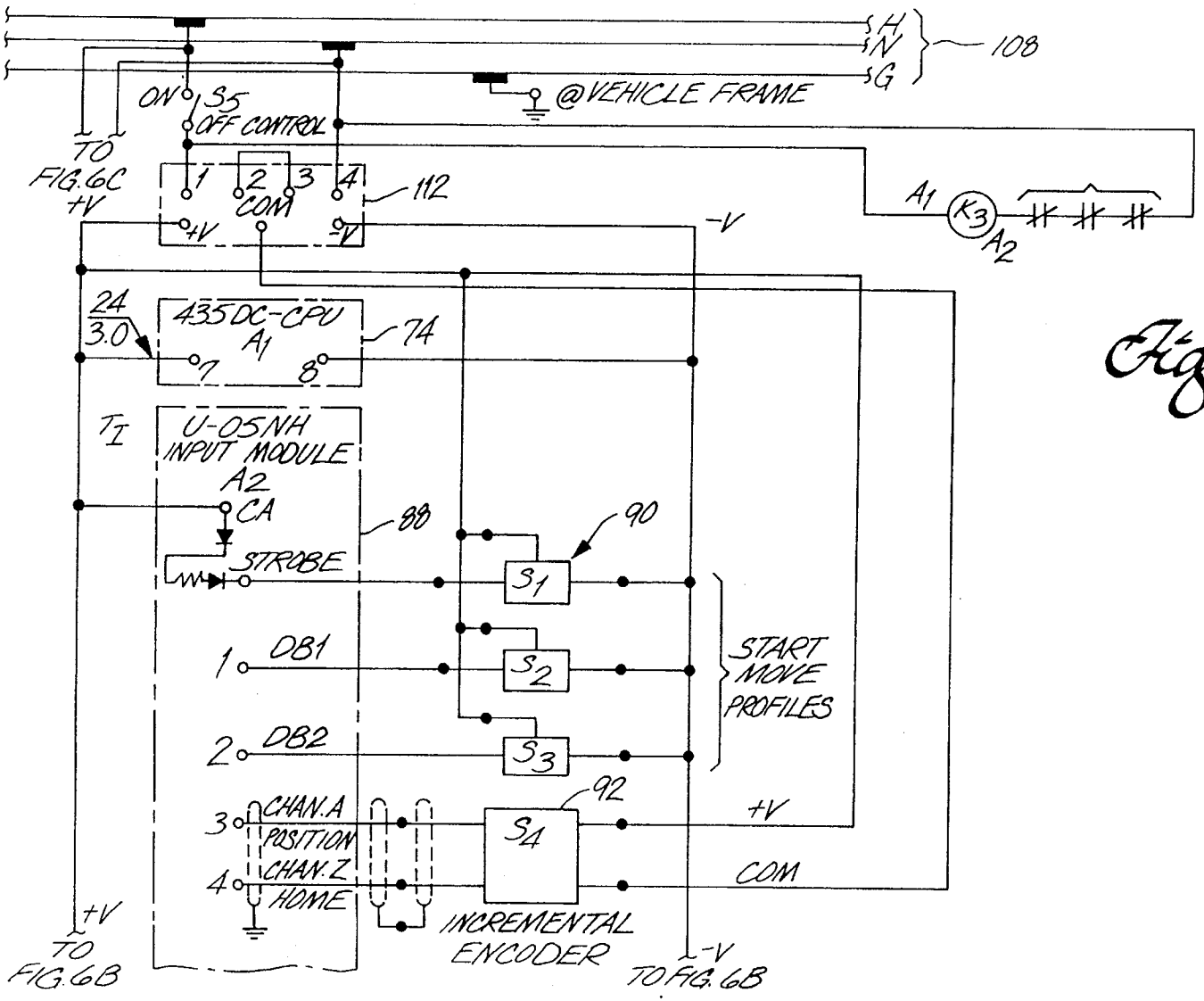
FIG. 6*a–c* is a detail electrical schematic of the controller and sensor system for a car.
Figure 6B:
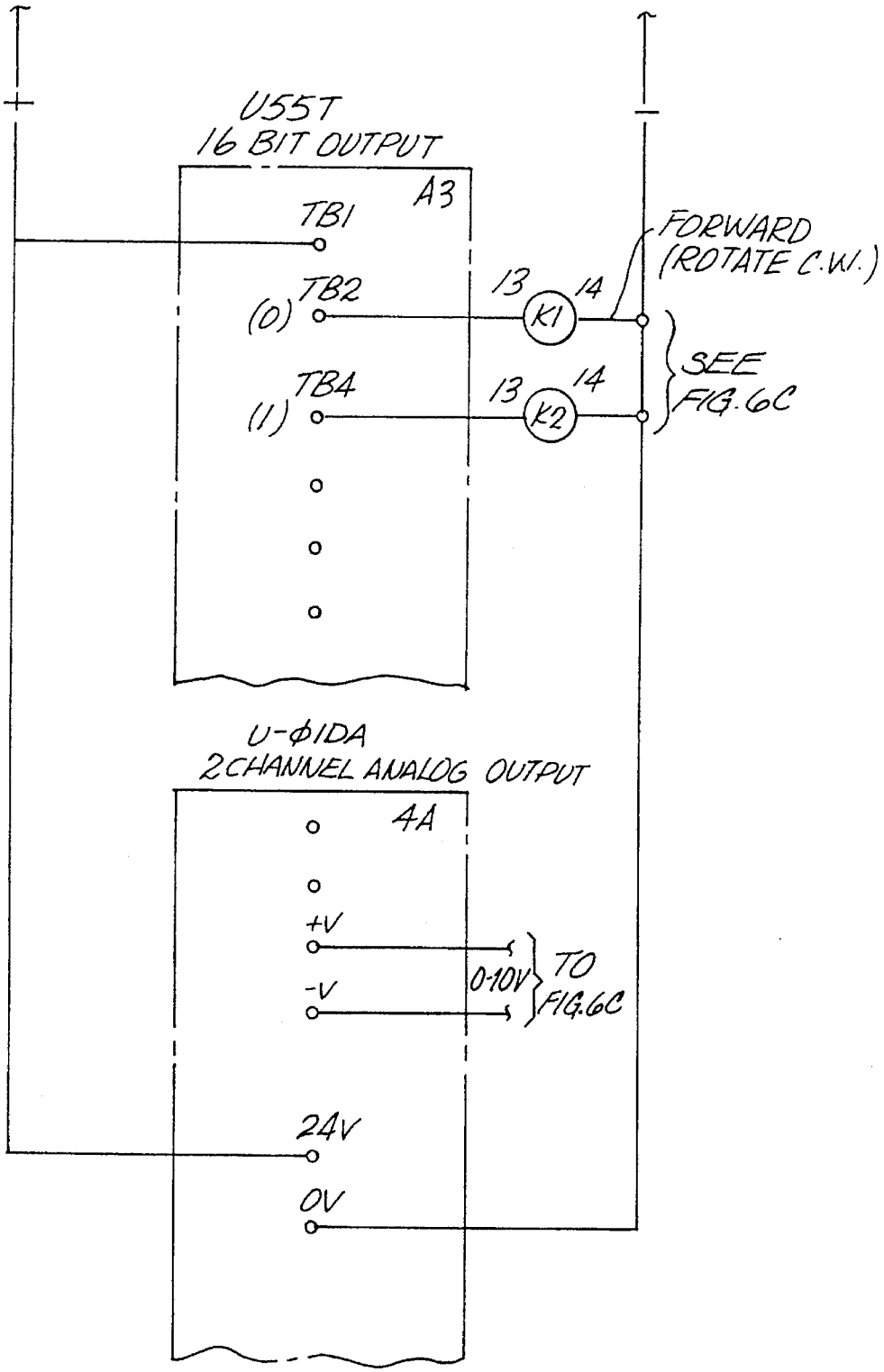
Figure 6C:
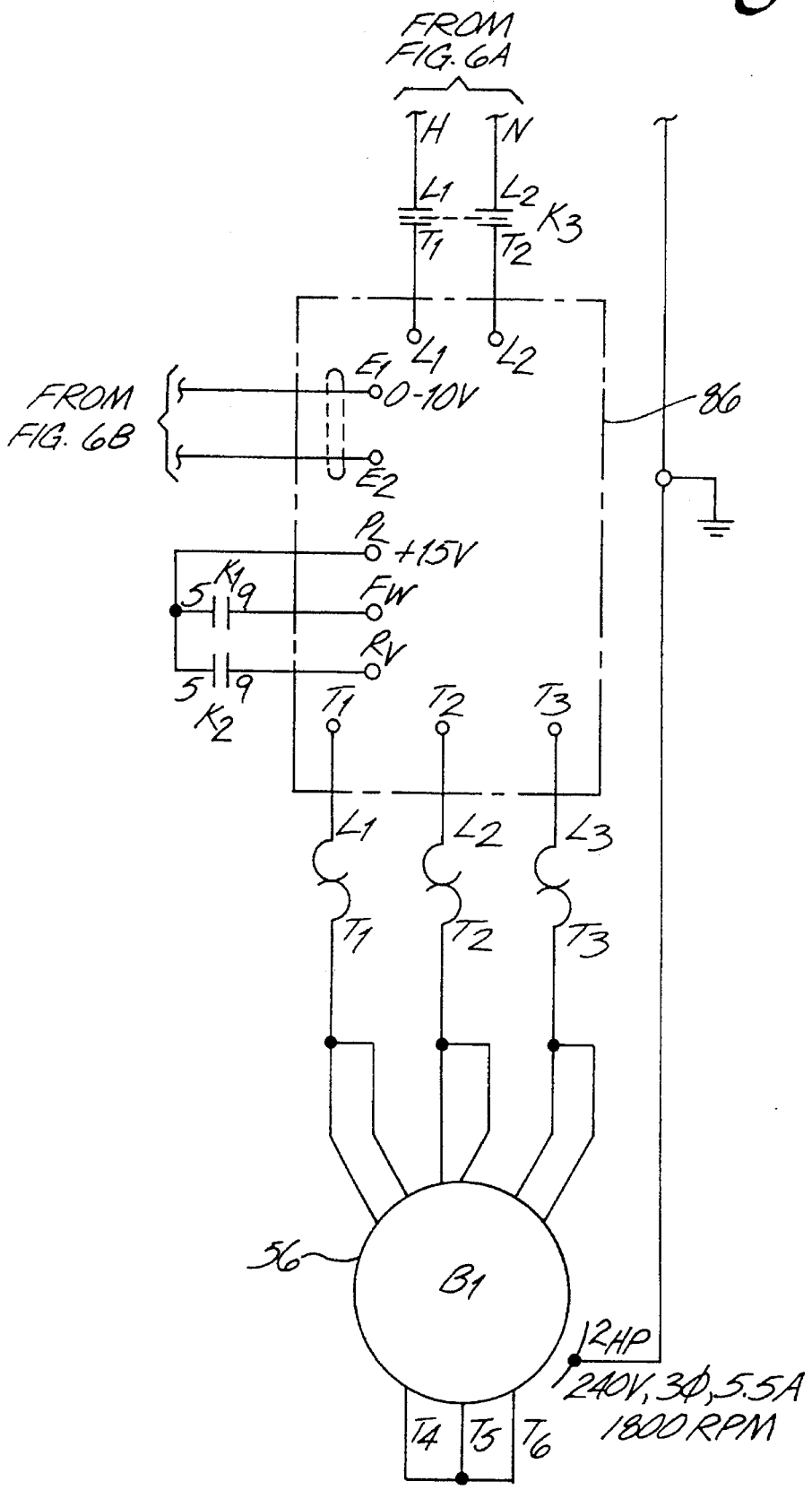

Turning to FIGS. 6*a–c*, a detailed schematic of an embodiment of the controller for the present invention is shown. Power for the controller is provided on bus bars 108 having high (H) neutral (N) and ground (G) busses. The bus bars are mounted adjacent the track, as best seen in FIG. 2 wherein spring mounted contacts 110, attached to the dolly, engage the buses. A master on/off control switch S5 provides power to the controller in the car. A power distribution circuit 112 provides regulated power for the components of the controller. A Texas Instruments model 435DCCPU74 acts as the central processing unit for the controller. This CPU operates at 24 volts, 3 amps in a standard controller configuration. Inputs from the various sensors and encoders are received on the input card 88, which, in the embodiment shown, is a U-05NH input module by Texas Instruments. The 3 bits of the rotate program start sensor 90 are provided by individual sensors S1, S2, and S3. In the embodiment shown, sensor S1 provides a strobe to the input module for reading the data bits DB1 and DB2 provided by sensors S2 and S3. Four move profiles are provided by the strobe plus 2 data bits configuration. The incremental encoder 92 for the rotate axis employs a 2 channel sensor S4 having a first channel, CHAN A, detecting position based on the pulse counts originating from the sensor wheel, as described with respect to FIG. 2 and a second channel, CHAN Z, identifying the home position as previously described.

As shown in FIG. 6*b*, the digital output card 84 comprises a Texas Instruments U55T 16 bit output card. As previously described, functions of the digital output card employed in the present embodiment include signals for clockwise rotation and counter-clockwise rotation. Upon command from the CPU, the output from the U55T is provided to relay K1 on terminal 13 to command clockwise or forward rotation of the rotate motor. As shown in FIG. 6*c*, closure of relay K1 provides power continuity. through terminals 5 and 9 of relay K1 to the forward motion control FW of drive controller 86. Similarly, counter-clockwise rotation is activated by output from the U55T to relay K2 which provides power through terminals 5 and 9 to the reverse direction control RV of controller 86.

Analog outputs for velocity control of the drive motors is provided through the analog output card 82 which, in the embodiment shown, comprises a U-01DA two channel analog output card produced by Texas Instruments. The U-01DA provides variable voltage from 0–10 volts upon command from the CPU to terminals E1 and E2 of the motor drive controller 86. The motor drive controller converts the 0–10 volts analog signal and the forward/reverse control to three phase winding control for the rotate axis motor 56.

Control configuration of the U55T and U-01DA for outputs to the tilt axis drive motor through its respective motor drive controller are identical in configuration.

Safety control for operation of the rotate and tilt axis motors is provided through power breaker K3 shown in FIG. 6*a* for providing power to the motor drive controllers shown in FIG. 6*c*. Activation of the motors is therefore only enabled when the master on/off switch is on, activating the individual car. Separate control of individual cars using the present invention, allows individual cars to be removed from service for faults, maintenance requirements, or if the number of patrons participating in the ride only requires activation of a limited number of cars. In addition, control of tilt and rotation of the seat portions on individual cars allows secondary programming of the controllers for maintenance or custodial functions whereby rotation profiles may be changed or eliminated to meet servicing requirements.

Having described the invention in detail as required by the patent statutes, those skilled in the art will recognize modifications and substitutions to the embodiments shown and described, as required for specific implementations. Such modifications and alterations are within the scope of the present invention, as defined in the following claims.

What is claimed is:

1. A system for patron movement along a multi-dimensional track comprising:

a car having a seating portion and a dolly engaging the track;

a controllable drive means for changing position of the seating portion relative to the dolly; and an independant programmable controller connected to the drive means for providing position commands to the drive means.

2. A system as defined in claim 1 wherein the drive means comprises;

a first motor;

articulating means interconnecting the first motor and the seating portion, the articulating means rotating the seating portion about a first axis; and a position sensor detecting the amount of rotation of the seat portion about the first axis and providing an output to the controller.

3. A system as defined in claim 2 further comprising:

a command sensor mounted to the car and a sensor activator positionable proximate the track to be passed by the car, the sensor providing a signal to the controller, and the controller providing a preprogrammed command to the drive means responsive to the signal.

4. A system as defined in claim 3 further comprising:

a second motor and wherein the articulating means interconnects the second motor and the seating portion and rotates the seating portion about a second axis; and a second position sensor detecting the amount of rotation about the second axis and providing an output to the controller.

5. A system as defined in claim 4 wherein the controller includes a timer and provides preprogrammed commands to at least one of the first motor and second motor responsive to elapsed time.

6. A system as defined in claim 5 wherein the timer is activated by the controller responsive to the signal from the command sensor.

7. A system as defined in claim 4 wherein the controller provides preprogrammed commands to at least one of the first motor second motor responsive to the command sensor signal.

8. A system as defined in claim 5 wherein the command sensor signal incorporates coded information received from the sensor activator and the programmed commands are selected by the controller responsive to the code.

9. A system as defined in claim 8 further comprising:

a safety sensor providing an output to the controller and wherein the controller executes preprogrammed commands responsive to the output signal from the safety sensor.

10. A system as defined in claim 9 further comprising:

an auxiliary sensor mounted to the car and a second sensor activator positionable proximate the track to be passed by the car;

the auxiliary sensor providing a signal to the controller; and the controller providing a preprogrammed command to an auxiliary system mounted in the car.

11. A system as defined in claim 10 wherein the auxiliary system is a digital audio system.

12. A system as defined in claim 10 wherein the auxiliary sensor signal incorporates coded information received from the second sensor activator and the preprogrammed commands are selected by the controller responsive to the code.

13. A method for controlling a system for patron movement along a multi-dimensional track comprising the steps of:

positioning a sensor activator proximate the track;

moving a car along the track;

sensing passage of the sensor activator by the car;

controlling the position of a seating portion in the car responsive to passing of the sensor activator.

14. A method as defined in claim 13 wherein the step of controlling includes:

commanding the operation of a drive means to change the position the seating portion;

monitoring of a position sensing means to determine the position of the seating portion; and commanding the drive means to stop upon reaching a preprogrammed position.

15. A method as defined in claim 14 further comprising the steps of:

monitoring a timer and commanding the drive means to change the position of the seat portion in a preprogrammed response to the monitored time.

* * * * *